United States Patent [19]

Mayer et al.

[11] Patent Number: 4,577,955

[45] Date of Patent: Mar. 25, 1986

[54] ELECTROPHOTOGRAPHIC COPYING APPARATUS INCLUDING A GUILLOTINE CLEANER BLADE ARRANGEMENT AND METHOD OF OPERATION

[75] Inventors: Edward F. Mayer; Donald F. Pfeuffer, both of San Jose, Calif.

[73] Assignee: Ricoh Company, Ltd., Tokyo, Japan

[21] Appl. No.: 553,108

[22] Filed: Nov. 18, 1983

[51] Int. Cl.[4] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 3,740,789 | 6/1973 | Ticknor | 355/15 X |
| 3,783,781 | 1/1974 | Grommek | 15/256.51 X |
| 3,854,814 | 12/1974 | Jones | 355/15 |
| 4,158,498 | 6/1979 | Ohmori | 355/15 |
| 4,174,172 | 11/1979 | Lane | 355/15 |
| 4,252,433 | 2/1981 | Sullivan | 355/15 |
| 4,297,026 | 10/1981 | Honda et al. | 355/15 |
| 4,357,098 | 11/1982 | Endo | 355/15 |
| 4,417,365 | 11/1983 | Murasaki | 355/15 X |
| 4,502,779 | 3/1985 | Kajita et al. | 355/15 |

*Primary Examiner*—Fred L. Braun

*Attorney, Agent, or Firm*—Flehr, Hohbach, Test, Albritton & Herbert

[57] ABSTRACT

A particle cleaning blade is mounted to cause the edge of the cleaning blade to describe an arc having both radial and axial components relative to the drum surface so that at its lowest point the blade comes into contact with the surface of the photoconductive drum. The mounting incorporates sufficient mechanical tolerances in the mechanical components to cause the final position of the blade relative to the surface of the drum to shift slightly from one wiping sequence to the next; any defects in the blade are shifted laterally across the drum. The mounting is a parallelogram type arrangement, which is spring-biased to hold the blade in a position removed from the surface of the drum by rotating the sides away from the vertical. A solenoid actuator is provided, located laterally with respect to the parallelogram and near one upright side. When the solenoid is actuated, it overcomes the biasing spring force, and draws the arms upright by overcoming the spring biasing force. The mounting which supports the parallelogram ideally also incorporates a scraper blade made of a flexible sheet of material held against the side of the cleaner blade.

14 Claims, 4 Drawing Figures

ELECTROPHOTOGRAPHIC COPYING APPARATUS INCLUDING A GUILLOTINE CLEANER BLADE ARRANGEMENT AND METHOD OF OPERATION

The present invention relates generally to an electrophotographic copying apparatus and more particularly to a specific arrangement for and method of cleaning toner residue from the surface of a photoconductive drum forming part of an electrophotographic copying apparatus.

A typical electrophotographic copying apparatus of the type in which the present invention is particularly useful includes a rotating photoconductive drum; means for establishing a electrostatic latent image corresponding to an original to be copied on the outer circumferential surface of the drum; means for applying toner to this latent image bearing surface to develop the image; and means for transferring the applied toner from the drum surface to a blank sheet of paper to transform the latter into a copy of the original. This type of arrangement also includes an arrangement for cleaning toner residue from the drum surface immediately after a copy has been made. Typically, a doctor blade or the like is moved into and out of engagement with the drum surface as the latter rotates by means of a solenoid actuator.

A major problem with this type of prior art arrangement has been that with time, defects may appear in the surface of the blade. As a result, some of the toner particles which are quite small, will pass under the edge of the blade. This problem is accentuated by the fact that in the optimum cleaning blade arrangement, the blade is held somewhat flexibly so that it is bent away from a plane which passes through the axis of the drum to promote a wiping action. This arrangement makes it less likely that a blade with surface defects in the wiping edge thereof will fail to catch all of the residual particles on the surface of the drum.

It is therefore an object of the present invention for providing a means whereby the wiper blade comes to rest in a slightly different lateral position with respect to the surface of the drum each time the blade is brought into contact with the surface of the drum.

Some prior art attempts to overcome this same problem have been based on the use of a separate mechanical structure apart from the mechanism which is used to lower the blade into contact with the surface to provide some transverse motion of the blade with respect to the surface. However, obviously this requires a separate mechanical driving arrangement and linkage leading to a much more complicated cleaning arrangement. Moreover, the small incremental movements across the surface of the drum are extremely hard to achieve because of the inherent inertia both mechanical and frictional of the blade with respect to any axial movement across the surface. Finally, axial movement across the surface once the blade has come to rest thereon could easily result in scarring of the drum, the most expensive single element in such an electrophotographic copier.

Therefore, a major objective of the present invention is to incorporate some axial movement, however slight, of the blade relative to the drum surface into the path of movement of the blade onto the surface of the drum, so that both the radial and axial movements are completed when the blade comes to rest.

It should be noted in understanding this invention that because of the microscopic size of both the particles and any potential defects in the blade that no major incremental movement of the blade across the surface is necessary for the system to be effective.

The above objectives are achieved in the present invention by mounting the particle cleaning blade in a mounting which causes the edge of the cleaning blade to describe an arc having both radial and axial components relative to the drum surface so that at its lowest point the blade comes into contact with the surface of the photoconductive drum. The mounting itself incorporates sufficient mechanical tolerances in the mechanical components to cause the final position of the blade relative to the surface of the drum to shift slightly laterally or axially across the drum from one wiping sequence to the next, whereby any defects in the blade are shifted laterally across the drum so that residual toner missed on one pass of the drum due to a blade edge defect will be wiped off on the succeeding pass.

The mounting in a preferred embodiment comprises a parallelogram type arrangement, which is spring-biased to hold the blade in a position removed from the surface of the drum by rotating the sides away from the vertical. A solenoid actuator is provided, preferably located laterally with respect to the parallelogram and near one upright side. When the solenoid is actuated, it overcomes the biasing spring force, and draws the arms upright by overcoming the spring biasing force. As the parallelogram moves from comprising an acute angle between blade and side to a substantially rectangular parallelogram, the blade is brought into contact with the surface of the drum.

The mounting which supports the parallelogram ideally also incorporates a scraper blade comprising a flexible sheet of material held against the side of the cleaner blade. The scraper blade reaches the bottom edge of the cleaning blade only when the blade is withdrawn from the surface of the drum. The lower edge of the cleaning blade is below the scraper blade when it is in contact with the surface; as the blade is drawn away from the surface of the drum to its resting position, the scraper blade scrapes the toner from the cleaning edge or side of the cleaning blade and deposits it on a portion of the drum which trails the latent image area. The drum then carries this deposited toner around the drum through the erase area which removes any charge on the photoconductive drum which would attract this residue to the drum. This allows the residue to fall into the developer tank as the drum rotates past the tank. Also, the scraping leaves the cleaning blade ready to clean during the next succeeding cycle.

It should be noted that the ideal arrangement of this parallelogram mounting allows for some movement or deflection of the blade in the direction of the travel of the surface of the drum, in order to promote a wiping action of the blade across the surface of the drum. Therefore, the mounting for the movable blade incorporates a laterally extending finger substantially even with the rear surface of the blade to limit the circumferential deflection of the blade. The fixed mounted also includes one sliding surface on which this laterally extending finger may slide, so that the blade may be easily withdrawn from the surface of the drum.

This subject invention will be more fully understood both as to its mechanical embodiment and its obvious advantages with reference to the accompanying figures wherein.

Figure 1:
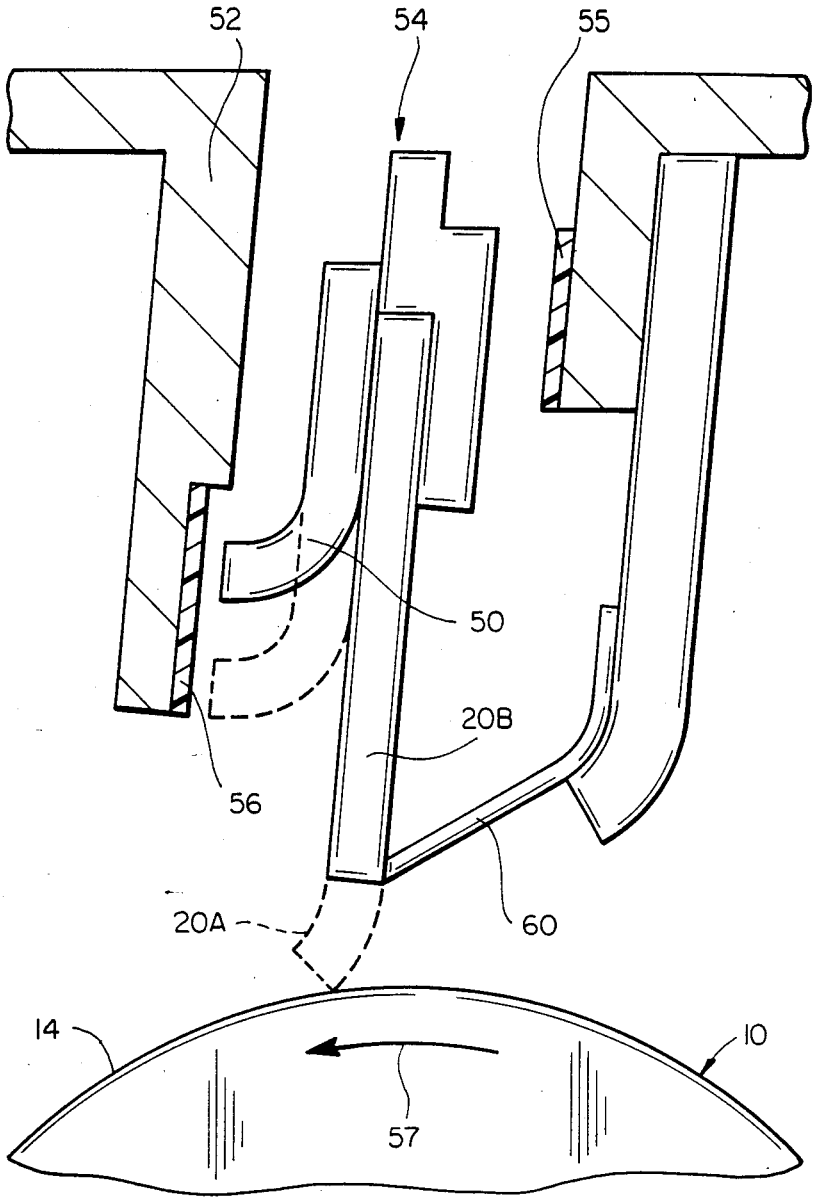
FIG. 1 is a front elevational view of the mounting of the blade.
Figure 2:
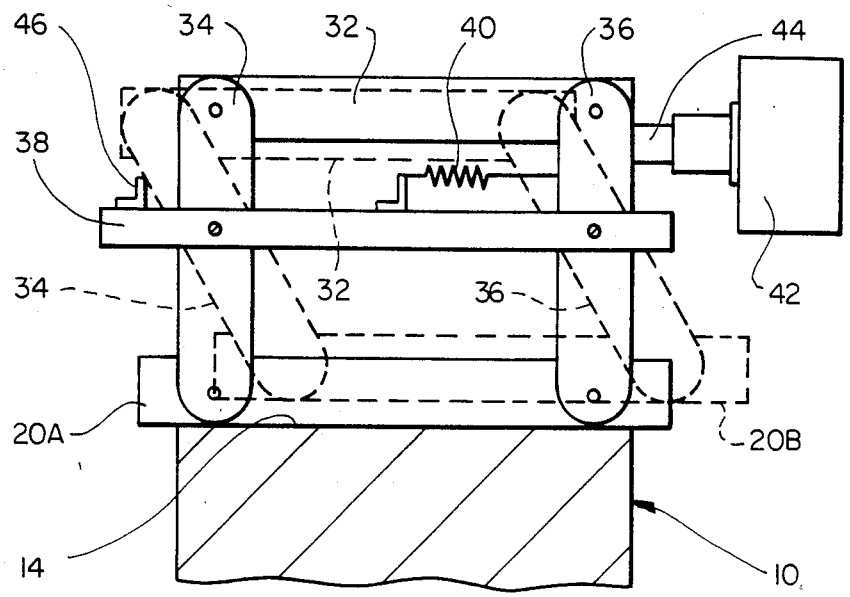
FIG. 2 is a side elevational view of the mounting of the cleaner blade and scraper blade.

Turning now to the drawing, wherein like components are designated by like reference numerals throughout the figures, attention is directed to FIG. 1 and FIG. 2 which diagrammatically illustrate the inventive arrangement for cleaning toner residue from the surface of a photoconductive drum 10. The drum is a part of an electrophotographic copying apparatus which includes means for rotating the drum 10 in a controlled way; means for placing an electrostatic image corresponding to an original to be copied on outer surface 14 of the drum; means for applying toner to the image bearing surface to develop the image with the toner; and means for transferring the applied toner from the drum surface to a blank sheet of paper to transform the latter into a copy of the original. The overall apparatus also includes other means not shown such as a station for fusing the transferred toner to the blank paper. However, since these various stations do not form an integral part of the present invention, but rather are a part of the overall environment in which this invention may be used, they are not discussed in detail herein.

The important part to note is that after the copy has been made by transferring the toner from the latent image to the blank sheet of paper, some untransferred or residual toner remains on drum surface 14. This residue must be removed before the copying process can be repeated; otherwise it will appear as black or grey areas on succeeding copies. Moreover, the attraction of the toner residue to the drum surface is sufficiently strong that a simple electrical discharging of the surface of the drum (which does occur at a point beyond this mechanical cleaning station) does not ensure that all of the residual toner will simply fall off the drum into the developing station.

A further important consideration in the design of this invention is the known fact that the particles of residual toner which we are dealing with are extremely small. Therefore, even microscopic defects in the surface of the blade which is used to mechanically remove the toner from the image area of the drum surface can cause some of the toner to be left on the surface. If these defects in the blade always rest on the same point on the drum surface 14 then toner which lies in certain spots will not be cleaned from the surface, resulting in black spots or streaks on the surface of copies.

Figure 3A:
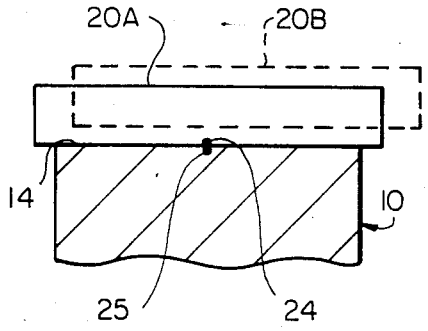
FIGS. 3A and 3B are sectional views showing the position of the blade relative to the drum.
Figure 3B:
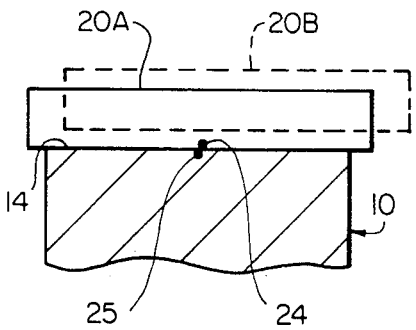

The general concept of the invention can be perceived by turning to FIG. 3. This figure shows the blade in its two positions, the position 20A representing its lowered position onto the surface of the drum for cleaning the drum and its position 20B where it is raised above the surface of the drum. As can be seen, according to the invention, the movement of the blade in fact describes a small arc, including both axial and radial components in its movement from its normal or rest position onto the surface of the drum where its cleaning action will take place. By designing a mechanical linkage preferably having the parallelogram form of FIG. 2 to provide this acurate movement, the normal tolerances within the mechanical linkage will result in minute variations in the resting place of the blade with respect to the surface of the drum each time that the blade is lowered onto the surface. Thus, in FIG. 3A, it can be seen that point 24 which is a point on the edge of the cleaning blade coincides with point 25 which is a point on the surface of the drum to be cleaned. In contrast, in FIG. 3B which represents the next successive lowering of the blade onto the surface of the drum, the point 24 has now moved slightly to the right of point 25 (with the distance of movement being, of course, exaggerated for purpose of illustrating the invention). It is this minute change in positioning which is sufficient to move any microscopic defects in the edge of the cleaning blade laterally and randomly across the surface of the drum. Thus, particles of toner residue which are not cleaned from the surface of the drum on one pass are scraped off on one of the next successive passes. Thus the arrangement provided by this invention provides a significant improvement in the cleaning power of the cleaning blade provided herein.

The mechanical arrangement by which the preferred arcuate motion is achieved is illustrated most clearly in FIG. 2; the cleaning blade and the parallelogram form mounting which carries it are shown in solid lines in the actuated position for cleaning the surface of the drum, and in dotted lines in the blade's rest position. The mechanical structure by which this arcuate motion is achieved is of relatively simple design, leading to ease of maintenance; further, its profile is relatively low, making it useful in compact copiers which are coming into increasing usage. Considering specific details of the mechanical structure, the cleaning system of the present invention, in addition to the blade 20, comprises a parallelogram framework for mounting the blade comprising an upper parallel arm 32 and blade support arms 34 and 36. The parallelogram is mounted from a central mounting bar 38 by mounting means (not shown) and also includes a spring 40 having one end connected to one of the support arms of the parallelogram and the opposite end attached to the central mounting bar 38. This spring force is such that the resting position of the parallelogram is as shown in the dotted lines in this same FIG. 2, with the support arm 36 forming an acute angle with the blade 20. In this rest position the profile of the parallelogram is flattened, the upper horizontal bar 32 being lowered; concomitantly, the lower bar comprising the cleaning blade 20 is raised from the surface 14 of the drum. To achieve this bias force to define the rest position, the spring 40 needs simply to be mounted to the vertical upright 36 at a point preferably midway between the horizontal mounting bar 38 and the upper horizontal parallelogram section 32.

A solenoid 42 is located laterally of the upper portion of the parallelogram frame, and approximately although not necessarily exactly along the line of force of the spring 40. When the solenoid 42 is energized, the force of the spring 40 is overcome and the button 44 which is also attached to the vertical upright 36 is drawn to the solenoid. This solenoid action lowers the cleaning blade 20 onto the surface 14 of the drum 10 putting the blade into contact with the surface to clean the surface of toner residue. When the solenoid is de-energized, the action of spring 40 naturally returns the parallelogram to its lower profile position, raising the blade 20 from the surface of the drum. By this arrangement in the event of any power failure the blade is naturally withdrawn from the surface of the drum, preventing any damage. A stop 46 is also provided on the center mounting against which the left hand upright support arm 34 of the parallelogram comes to rest, in order to prevent the parallelogram from moving the blade an excessive distance from the surface of the drum.

Turning to FIG. 1, it can be seen that the blade 20 also has attached to the rear surface thereof a laterally extending finger 50. This finger 50 abuts a portion of a stationary metal piece 52, preferably a portion for the mounting of the movable parallelogram which carries the wiper blade, when the blade 20 is in the cleaning position. This finger 50 is provided so that the parallelogram mounting indicated generally at 54 may be provided with some lateral tolerance clearances to allow the drum to deflect the blade slightly in the direction 57 of its rotation; as a result of this deflection, a wiping action of the blade 20 along the surface 14 of the drum is created to promote the cleaning of the residue from the drum. To limit this lateral deflection of the blade, the finger 50 butts up against the surface 56. This surface also has a coating or covering of a slippery material such as Teflon thereon, so that when the solenoid is de-energized and the blade is retracted, the finger 50 moves smoothly up the surface 56 or next available number and does not retard the withdrawal of the blade from the surface of the drum. In order to allow for this inclined positioning of the blade, a similar sliding surface 55 is provided on which the upper portion of the parallelogram mounting 54 of blade 10 may also slide. Finally, a scraping blade 60 is provided comprising a flexible material. This blade 60 rests against the bottom of the cleaning blade 20 when the blade is in its retracted or resting position. When blade 20 moves to its energized position to clean the surface of the drum, the toner scraped from the surface of the drum comes to rest largely on the portions shown in dotted lines between the lower portion of the scraper blade 60 and the drum surface 14. When the blade 20 is retracted, the collected toner residue is now scraped by scraper blade 60 from this front surface of the front surface portion of the cleaning blade 20, to fall onto a portion of the drum which trails and does not comprise a part of the latent image area. Thus, as the drum rotates to the next station and all residue charge is removed, the toner now falls into the collector at the developing stations to await reuse in the future.

In summary, it can be seen that the blade 20 is normally in its retracted or rest position. During machine operation when the machine control program signals the solenoid 42 to clean the surface of the drum, the solenoid operates the parallelogram linkage and the cleaning blade is pressed against the photoconductive surface 14 of the drum. As the blade 20 cleans the drum, the toner residue generally adheres to the blade on the side of the blade closest to the transfer roll which the photoconductive drum has just left.

When the cleaning cycle is completed, the solenoid is deenergized and the return spring 40 acts upon the parallelogram linkage to return the cleaning blade to its rest position. During the lifting of the blade 20, the scraper blade 60 which is in contact with the side of the cleaning blade closest to the transfer roll causes the toner residue to drop onto the surface of the photoconductive drum in a dead band area which trails the latent image area. This scraping leaves the cleaning blade ready to clean effectively during each of the following cycles. The continued rotation of the drum carries the residue through the erase area wherein any charge on the drum which would attract residue to the drum is removed. This allows the residue to fall into the developer tank as the drum rotates past the tank.

The linkage described above comprises a highly reliable and effective system for repetitively cleaning the surface of the drum of all particles of toner residue. It can further be seen that the parallelogram linkage or framework has the further advantage of comprising an easily adjustable system to modify the pressure which is desired to be applied against the surface of the drum. Thus, it is possible to adjust the amount of deflection of the cleaning blade caused by rotation of the photoconductive drum. The deflection of the cleaning blade promotes the wiping of toner from the drum.

Modifications of the present invention may become apparent to one of skill in the art who studies this invention disclosure. Therefore, the subject invention is to be limited only by the scope of the claims which follow.

What is claimed is:

1. An assembly for cleaning the charged surface of a developing drum of electrically charged toner particles which are attracted to the surface of said drum comprising:

a movable parallelogram-shaped frame for carrying a cleaning blade toward and away from contact with said developing drum, a support for said parallelogram frame, said parallelogram frame being movable with respect to said support, means for initiating movement of said parallelogram frame toward said drum, said parallelogram frame providing both axial and radial components of movement of said blade with respect to said developing drum in moving said blade into contact with said drum, said parallelogram frame being relatively loosely mounted in said support, rotation of said drum causing a limited deflection of said blade in the direction of movement of said drum whereby a wiping action of said drum surface is established, said parallelogram frame including a finger extending laterally of the direction of travel of said parallelogram frame to limit the deflection of said blade.

2. An assembly as claimed in claim 1 wherein said means for initiating movement comprises a solenoid positioned laterally of said parallelogram frame.

3. An assembly as claimed in claim 1 wherein said support provides means for defining first and second positions for said parallelogram frame relative to said drum, said first position holding said blade radially and axially removed from said drum, said second position of said blade being in contact with said drum.

4. An assembly as claimed in claim 1 including means for biasing said parallelogram frame away from said drum.

5. An assembly as claimed in claim 1 further comprising a scraper blade located adjacent said cleaning blade for scraping residual toner from said cleaning blade.

6. An assembly as claimed in claim 1 wherein said drum rotates in a first direction, said toner carried by said drum contacting one side of said blade, said assembly including a scraper blade mounted on said support and stationary relative to said blade for cleaning said toner from said one side of said blade.

7. An assembly as claimed in claim 1 wherein said support includes a lower sliding surface substantially perpendicular to the direction of movement of said finger, whereby movement of said parallelogram frame is not inhibited by friction due to deflection of said finger.

8. An assembly as claimed in claim 7 wherein said finger is located adjacent to an upper portion of said blade.

9. An assembly as claimed in claim 8 wherein said support comprises an upper sliding surface adjacent to an upper portion of said parallelogram frame, whereby movement of said parallelogram frame toward and away from said drum is not inhibited by friction due to deflection of said blade.

10. An assembly as claimed in claim 9 wherein said blade comprises a flexible material such as plastic, or thin metal.

11. In an electrophotographic copying machine in which a photoconductive drum surface is moved past a series of stations including a charging station at which at least a portion of the surface is given a uniform electrostatic charge, an exposure station in which the charged surface portion is selectively discharged to represent a latent image in shades of white through black, a developing station for developing said image utilizing oppositely charged toner particles, and a transfer station for transferring said latent image to a copy sheet, an improved cleaning station for removing residual toner from the surface of said drum comprising a cleaning blade carried by support means for simultaneous axial and radial movement relative to the surface of said drum, said support means carrying said blade between a first position in contacting engagement with the surface of said drum and a second position out of contact with the surface of said drum, a scraper blade mounted adjacent said cleaning blade and in contact with said cleaning blade at least during withdrawal of said cleaning blade from the surface of said drum for removing said residual toner from the surface of said cleaning blade, said scraper blade comprising a flexible strip in contact under pressure with one side of said cleaning blade, said scraper blade reaching to the bottom of said one side of said cleaning blade when said cleaning blade is in the second position whereby said scraper blade is moved across said one side of said cleaning blade as the cleaning blade is moved from said first position in contact with said drum to said second position, said support means comprising a laterally extending finger for limiting the deflection of said cleaning blade in the direction of movement of said drum when said blade is in said first position.

12. The improved cleaning station as claimed in claim 11 wherein said support means comprises a frame wherein one side of said frame comprises said cleaning blade.

13. The improved cleaning station as claimed in claim 12 wherein said support means further comprises a fixed framework, said frame including said blade being movable within said fixed framework, and wherein said scraper blade is mounted on said fixed framework adjacent said movable cleaning blade for cleaning toner from said cleaning blade.

14. The improved cleaning station of claim 13 wherein said movable frame carrying said blade is relatively loosely mounted in said supporting framework, rotation of said drum causing a limited deflection of at least said blade in the direction of movement of said drum, whereby a wiping action of said drum surface is maintained.

* * * * *